US008322281B2

(12) United States Patent
Fischer

(10) Patent No.: US 8,322,281 B2
(45) Date of Patent: Dec. 4, 2012

(54) INKING UNITS OF A PRINTING PRESS

(75) Inventor: Michael Heinz Fischer, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 272 days.

(21) Appl. No.: 12/735,559

(22) PCT Filed: Jul. 28, 2008

(86) PCT No.: PCT/EP2008/059842

§ 371 (c)(1),
(2), (4) Date: Jul. 27, 2010

(87) PCT Pub. No.: WO2009/097912

PCT Pub. Date: Aug. 13, 2009

(65) Prior Publication Data

US 2010/0319560 A1 Dec. 23, 2010

(30) Foreign Application Priority Data

Feb. 8, 2008 (DE) ..... 10 2008 000 257

(51) Int. Cl.
*B41F 31/00* (2006.01)

(52) U.S. Cl. ..... 101/349.1; 101/350.3

(58) Field of Classification Search ..... 101/350.3, 101/352.06, DIG. 38, 349.1, 348, 350.1
See application file for complete search history.

(56) References Cited

U.S. PATENT DOCUMENTS

| | | | | |
|---|---|---|---|---|
| 3,508,489 | A * | 4/1970 | Norton | 101/148 |
| 4,007,683 | A | 2/1977 | Dickerson | |
| 4,569,306 | A | 2/1986 | Ito et al. | |
| 5,787,811 | A * | 8/1998 | Achelpohl et al. | 101/349.1 |
| 7,077,061 | B2 * | 7/2006 | Holm et al. | 101/212 |
| 8,156,865 | B2 * | 4/2012 | Luckhardt et al. | 101/352.01 |
| 2008/0163773 | A1 * | 7/2008 | Schneider et al. | 101/349.1 |
| 2009/0101036 | A1 * | 4/2009 | Heiler et al. | 101/483 |

FOREIGN PATENT DOCUMENTS

| | | | |
|---|---|---|---|
| CH | 614 157 | | 11/1979 |
| DE | 35 41 270 | A1 | 7/1986 |
| DE | 101 57 243 | A1 | 6/2003 |
| DE | 102 19 903 | A1 | 11/2003 |
| EP | 1 167 026 | A2 | 1/2002 |
| EP | 1 314 560 | A2 | 5/2003 |
| GB | 1 158 056 | | 7/1969 |
| GB | 1 366 228 | | 9/1974 |
| GB | 2 019 317 | A | 10/1979 |
| GB | 2 320 464 | A | 6/1998 |
| WO | 2006/100158 | A2 | 9/2006 |

* cited by examiner

*Primary Examiner* — Judy Nguyen
*Assistant Examiner* — Leo T Hinze
(74) *Attorney, Agent, or Firm* — Mattingly & Malur, P.C.

(57) ABSTRACT

A color deck of a printing machine is usable to ink a printing cylinder. A roller nip is formed by at least one friction cylinder that is driven by a drive motor for rotary movement. A free-wheel clutch is situated between the first friction cylinder and the drive motor for that first friction cylinder.

8 Claims, 12 Drawing Sheets

INKING UNITS OF A PRINTING PRESS

Figure 1:
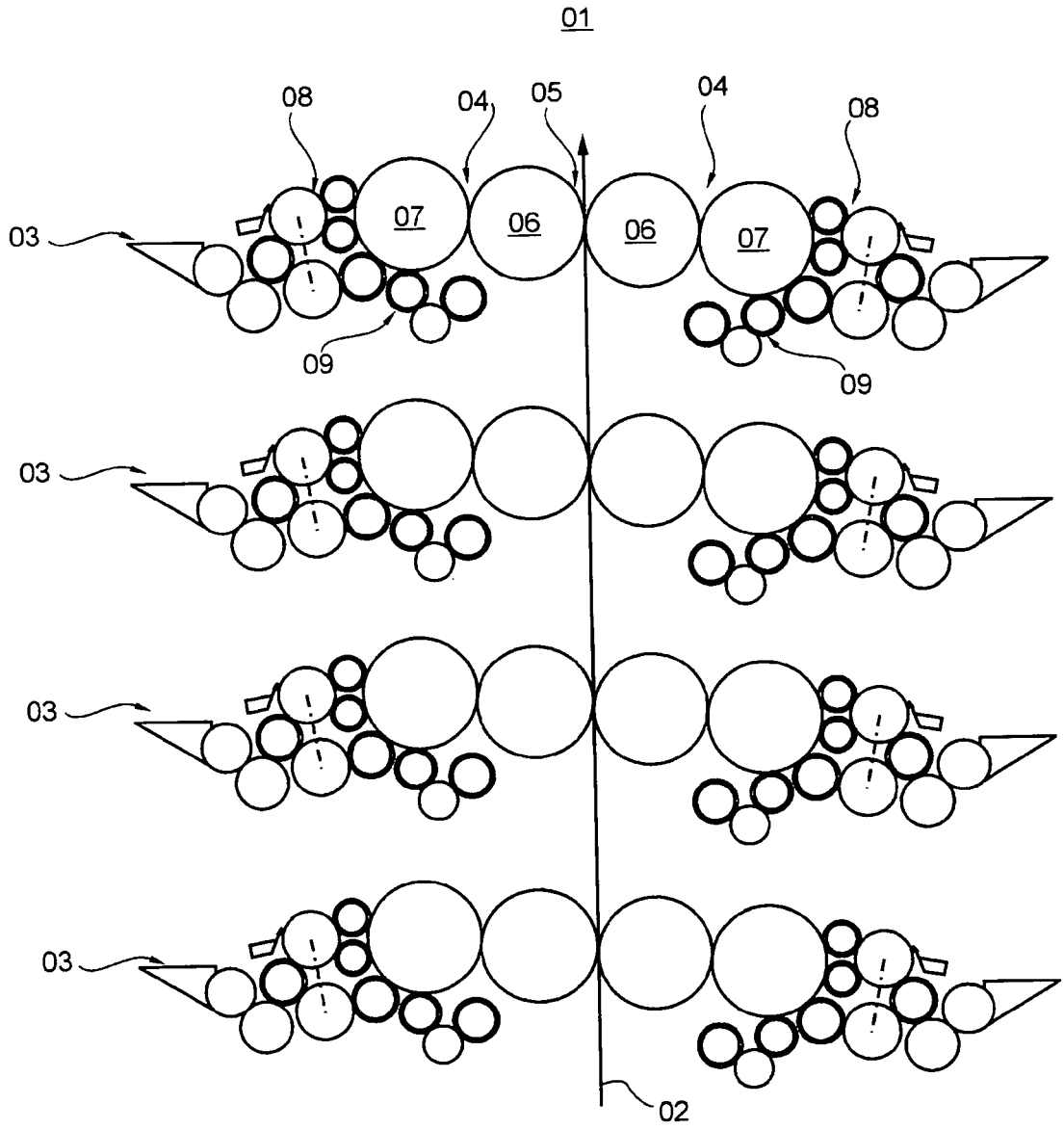

The invention relates to inking units of a printing press according to the preamble to claim 1 and claim 6, respectively.

From WO 2006/100158 A2, an inking system of a printing press for inking a forme cylinder is known which has a roller train with at least one distribution cylinder that is close to the forme cylinder and one that is farther away from the forme cylinder. The distribution cylinder that is close to the forme cylinder is rotationally driven solely via friction with adjacent rollers, i.e., it is configured without a mechanical drive connection to a drive motor that extends beyond friction by which it can be rotationally driven. In this manner, as compared with an inking unit which comprises a roller train having at least one distribution cylinder that is close to the forme cylinder and one that is farther away from the forme cylinder, both of which are rotationally driven, an improved flow of ink is produced by achieving a nearly undisrupted rolling of adjacent rollers against one another in the area of the roller train that is close to the forme cylinder. In addition, reduced wear and tear, along with decreased energy use and decreased control system complexity are achieved.

From CH 614 157 A an inking system of a printing press is known, wherein a distribution cylinder of the inking system can optionally be driven by an auxiliary motor which is reversible.

The object of the invention is to devise inking units of a printing press.

The object is attained according to the invention with the characterizing features of claim 1 and claim 6, respectively.

It is clear that the invention is implemented in every case in such a way that an inking unit, which comprises a roller train with at least one distribution cylinder, has a drive for all the distribution cylinders in a washing function counter to a production direction of rotation, whereas in a production direction of rotation, at least not all the distribution cylinders have a drive, rather at least one distribution cylinder is configured without a drive in the production direction, and is then driven by means of friction with at least one other roller.

The benefits to be achieved with the invention consist especially in that, particularly during cleaning or in the event of an ink change; increased cleaning quality is achieved, without having to dispense with known inking units.

It is advantageous for at least one first distribution cylinder of a roller train to have no drive connection to a drive motor in the production direction, and instead to be rotationally driven in the production direction solely via frictional contact with cooperating rollers. It thereby executes no rotational movement forced via a mechanical drive connection with a drive motor in the production direction, whereas a second distribution cylinder, for example, situated farther away from the forme cylinder, or in the case of a dual-track roller train, close to the dampening unit, preferably receives driving power in the production direction via a mechanical coupling with a drive motor, in addition to the friction gearing of the rollers. And conversely, a better result is achieved by using a positive drive for the distribution cylinders during set-up operation, in which, for example, the inking unit is washed or doctored in a direction of rotation counter to the production direction of rotation. Thus, for example, a doctor blade can be employed without the distribution cylinder remaining stationary.

In an advantageous further development, the inking unit or the roller train of the inking unit can be embodied as a module with its own side frame. The drive of the inking unit can also be embodied as a modular transmission with a separably connected drive motor, and can be separably connected to the side frame of the inking unit before being installed in the printing press.

In an additional advantageous further development, at least one distribution cylinder can preferably be swiveled outward by means of a swiveling connecting-rod mechanism when said cylinder is in idle mode, for purposes of maintenance. This serves to simplify maintenance operations by improving accessibility.

Further, according to another advantageous further development of the invention, identical or structurally equivalent transverse oscillation gearing assemblies can be used for all formats, that is, for different circumferences and different material web widths.

Exemplary embodiments of the invention are represented in the set of drawings and will be specified in greater detail in what follows.

Figure 3:
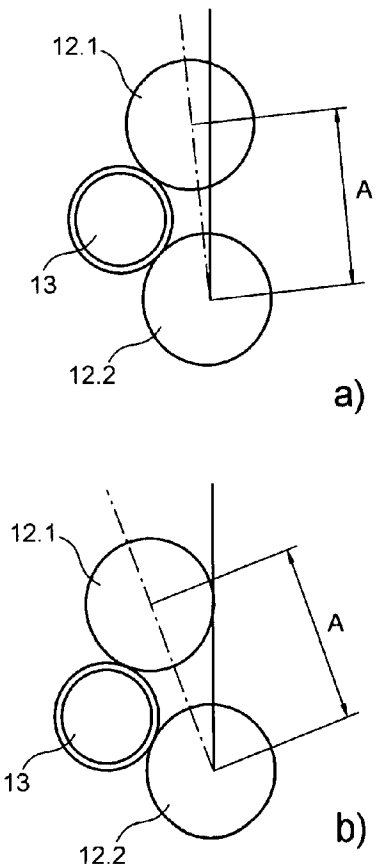
Figure 2:
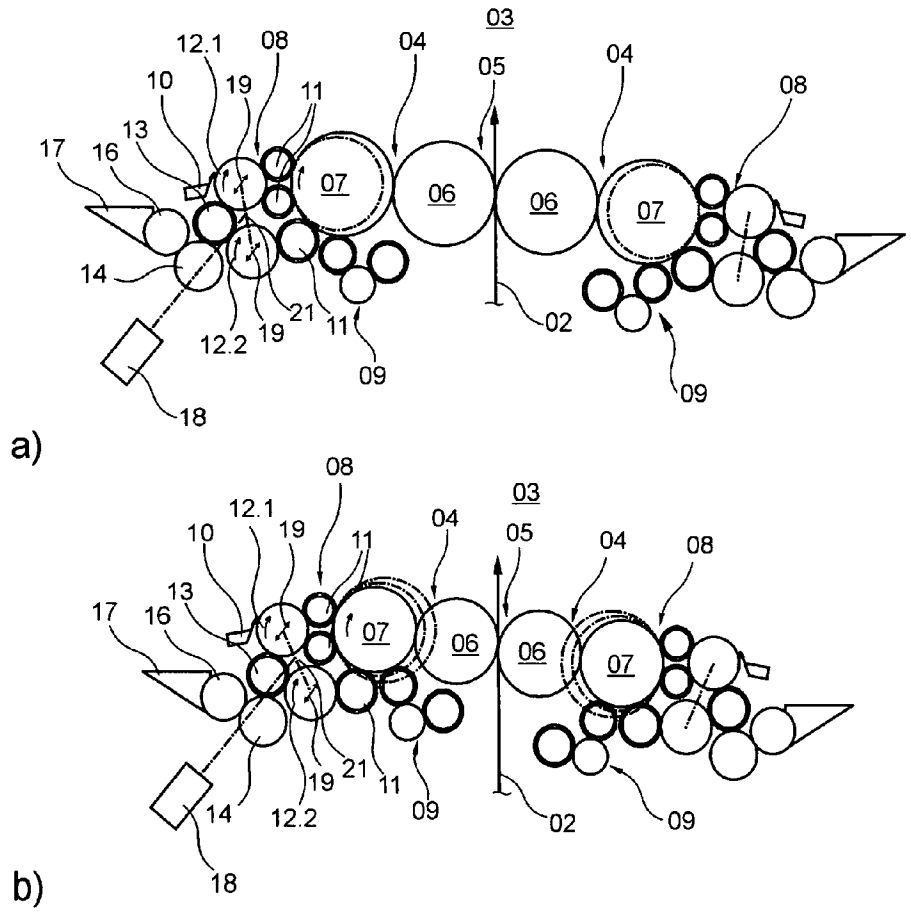
Figure 4:
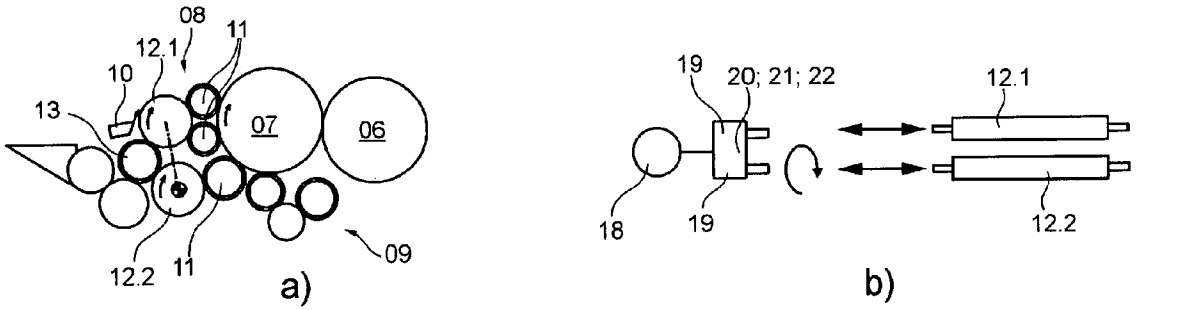
Figure 5:
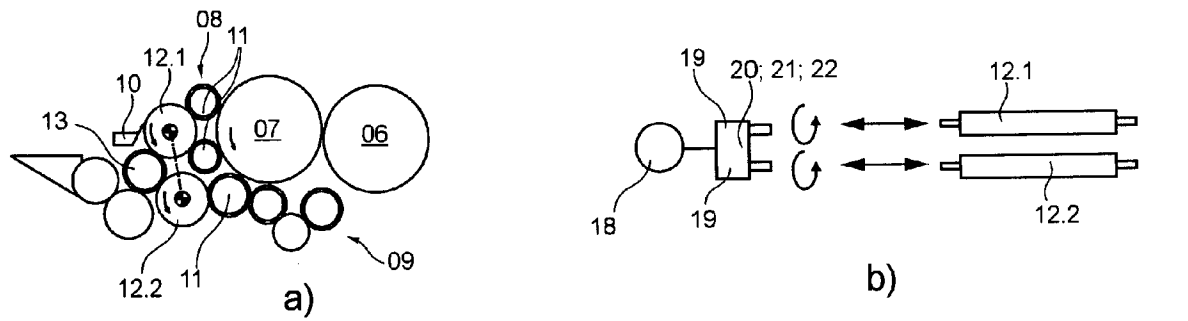
Figure 6:
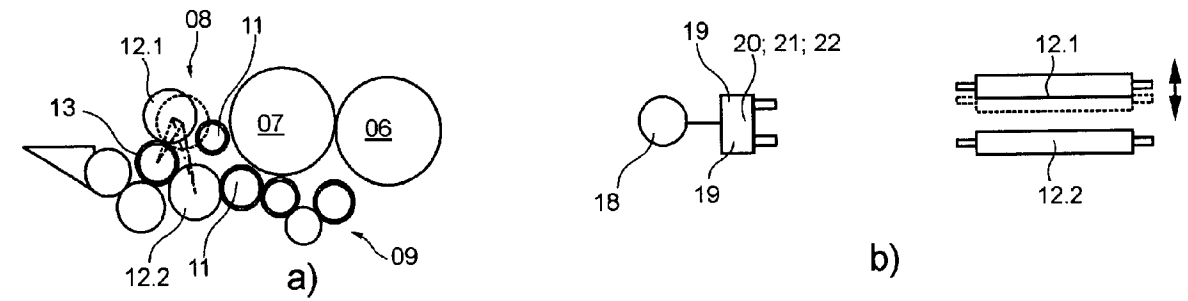
Figure 7:
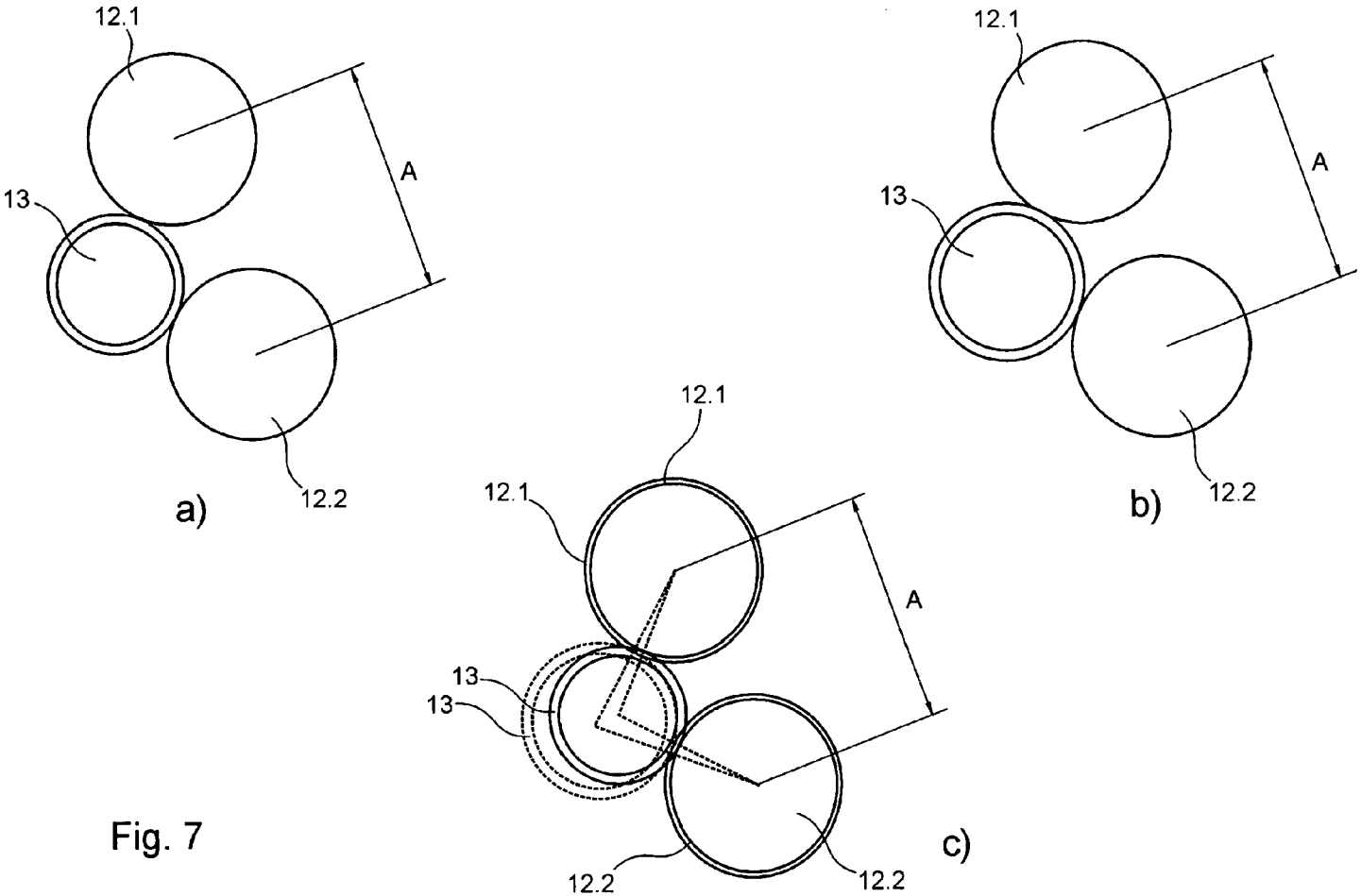
Figure 9:
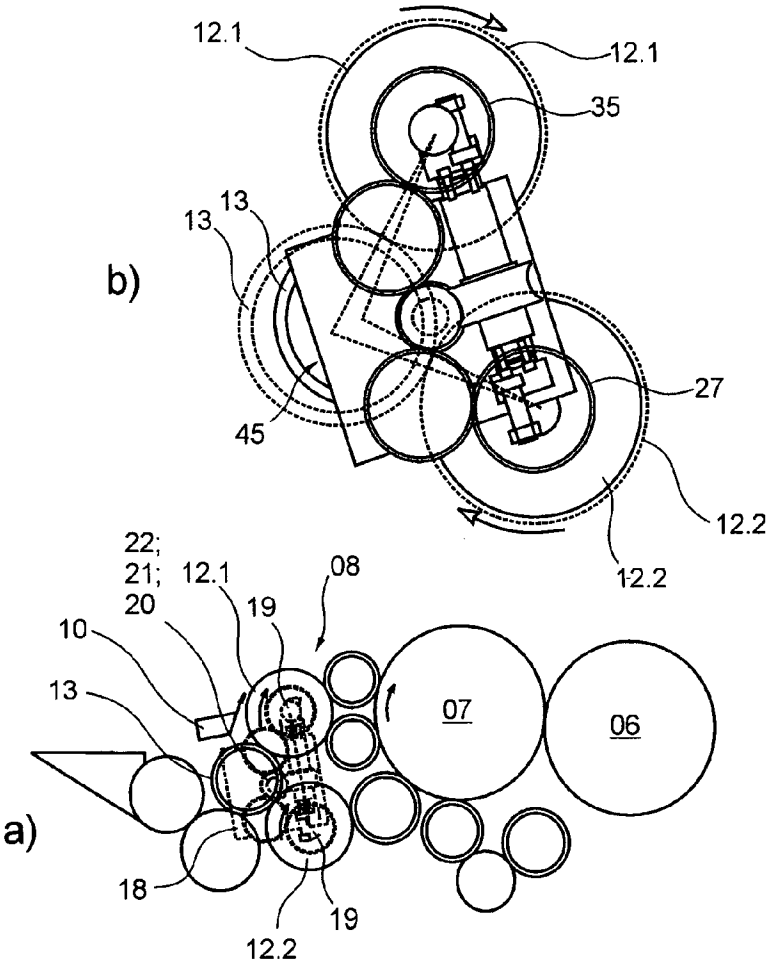
Figure 8:
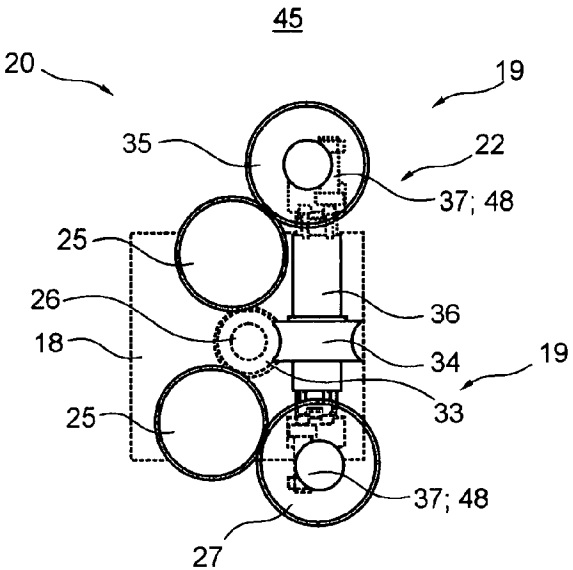
Figure 10:
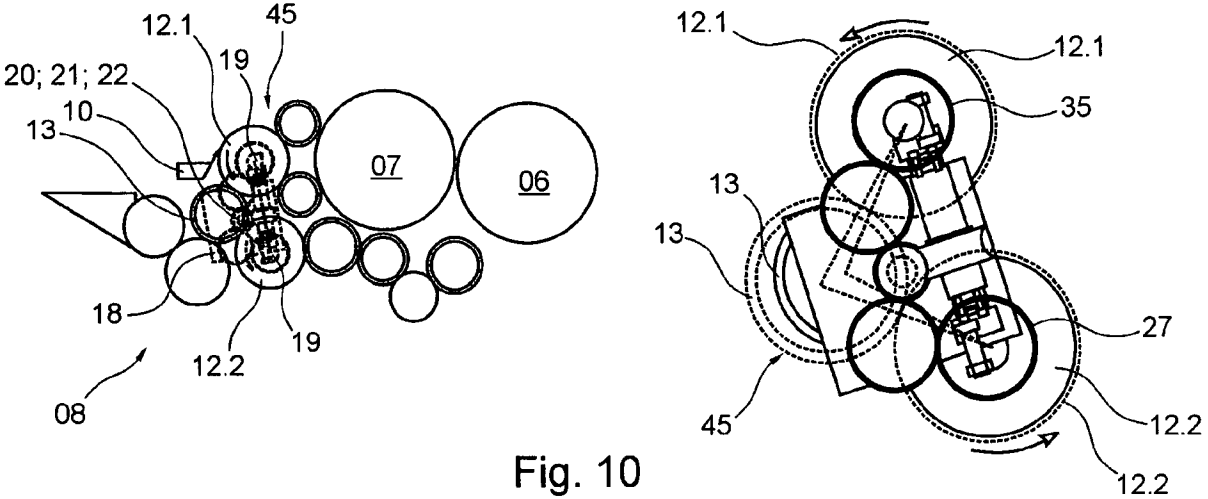
Figure 11:
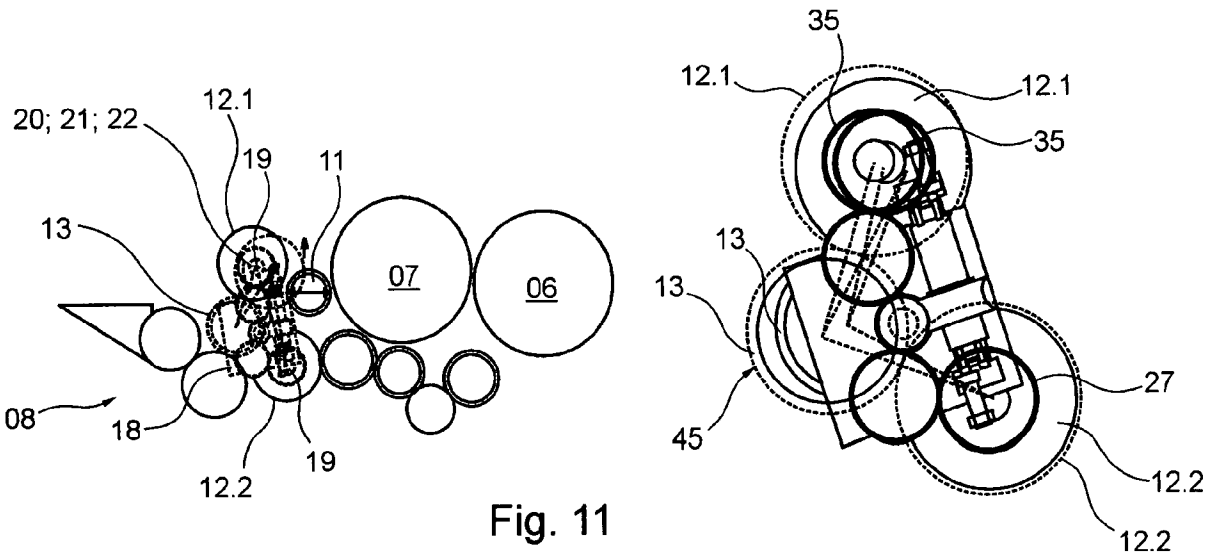
Figure 12:
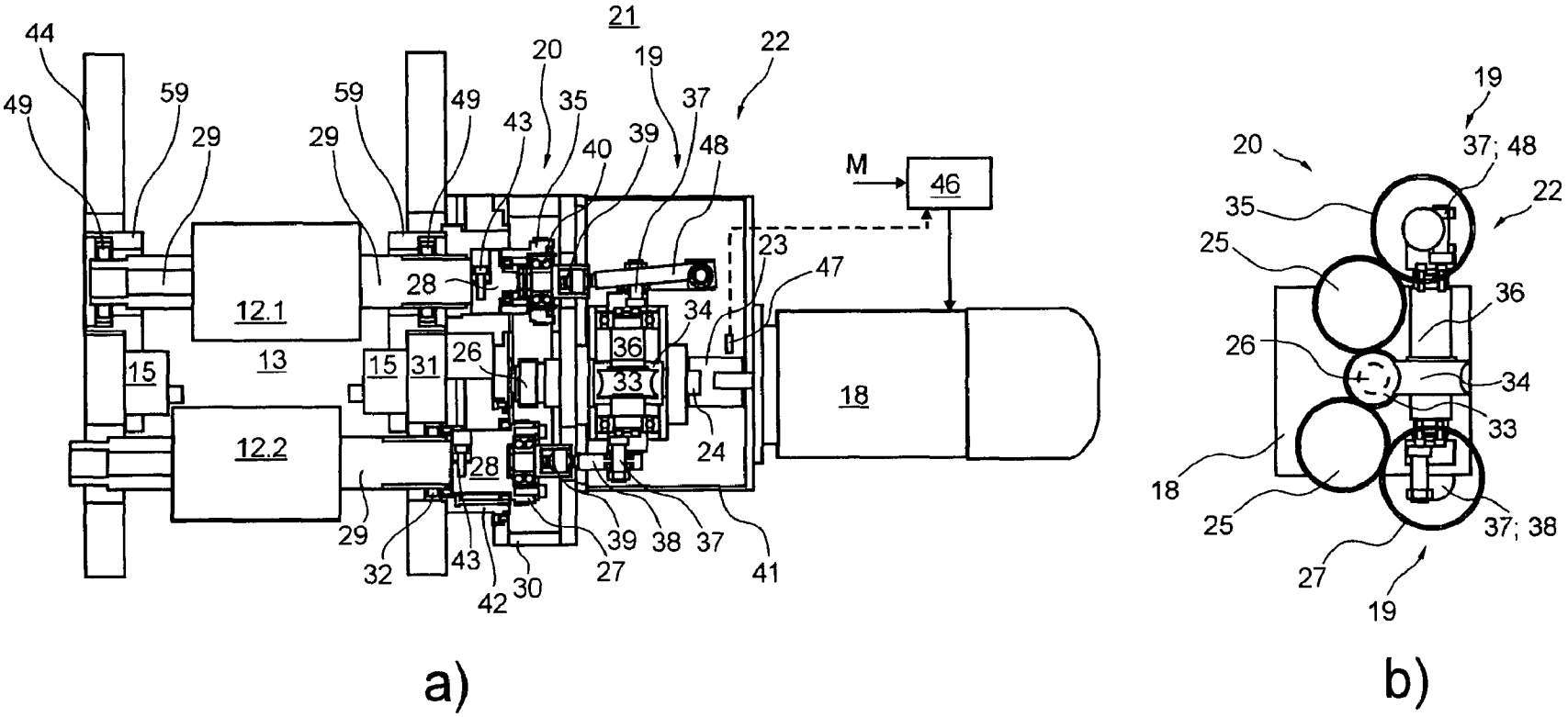
Figure 13:
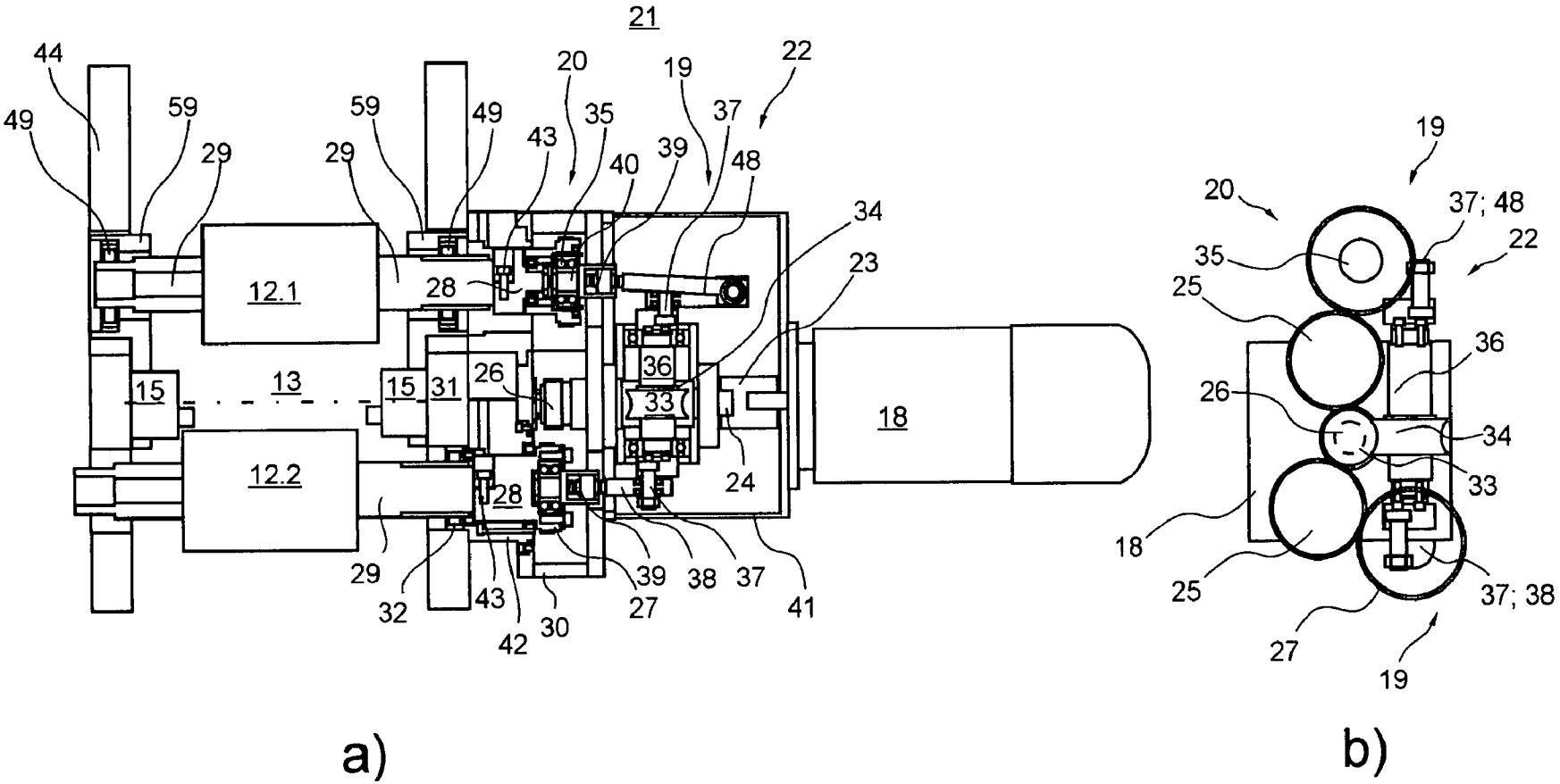
Figure 13:
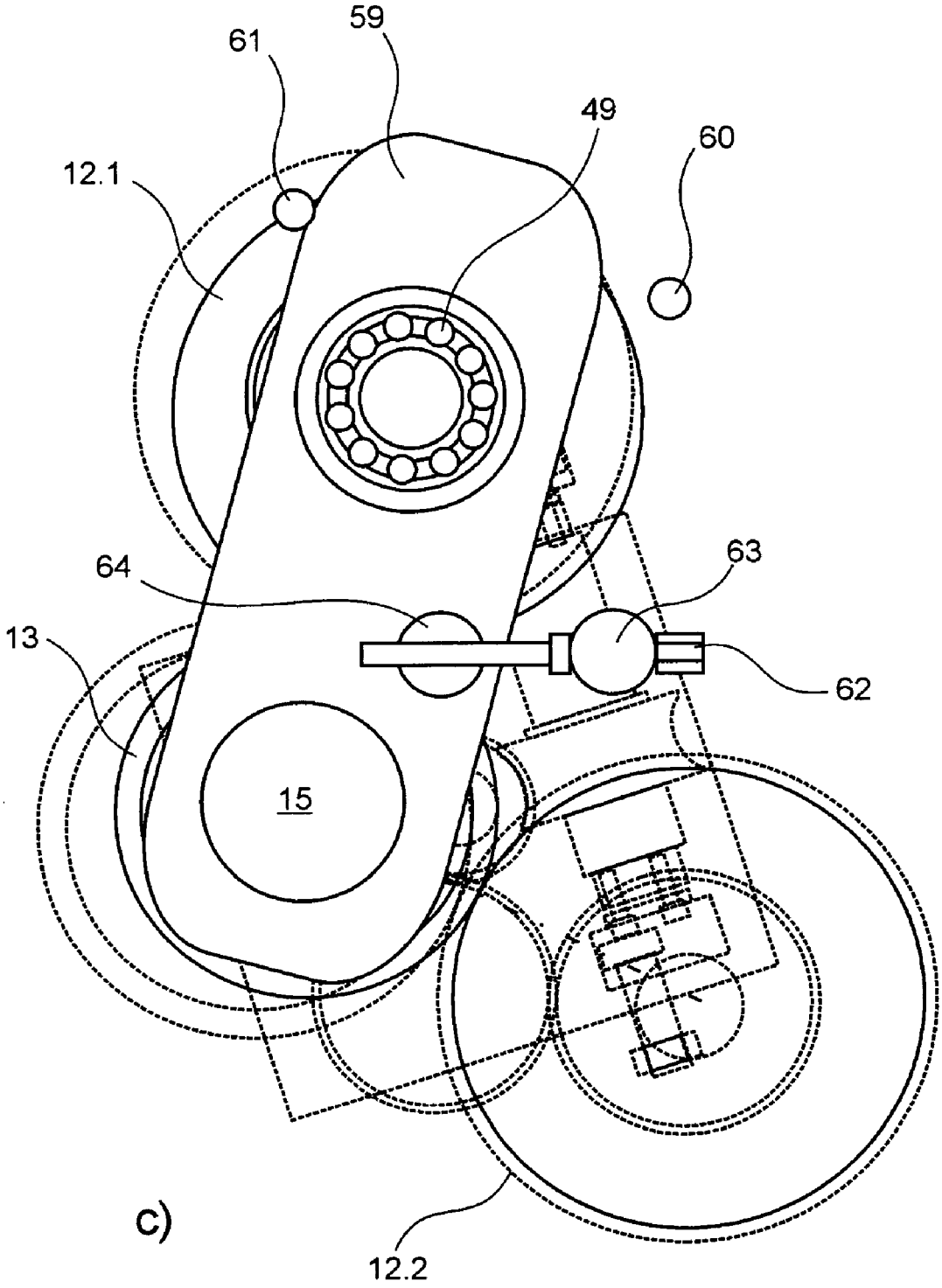
Figure 14:
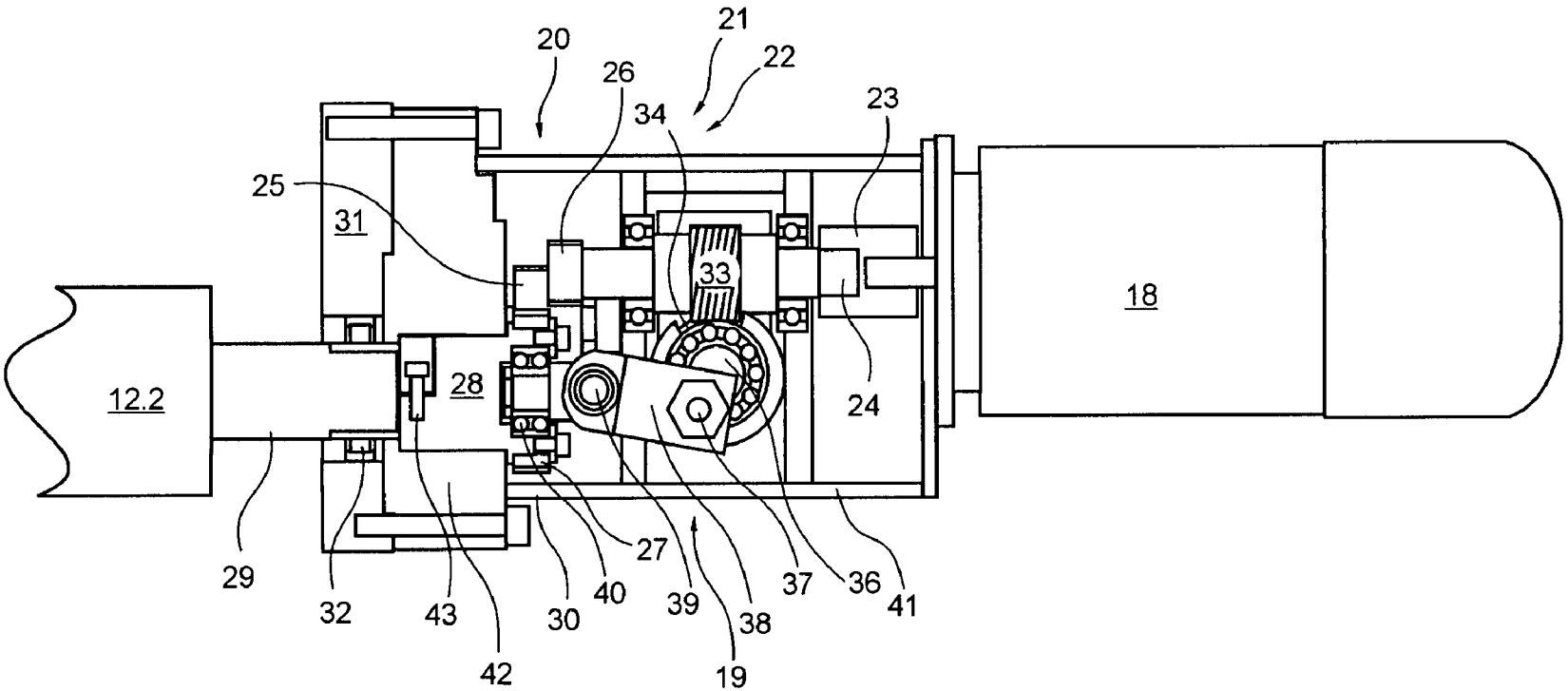
Figure 15:
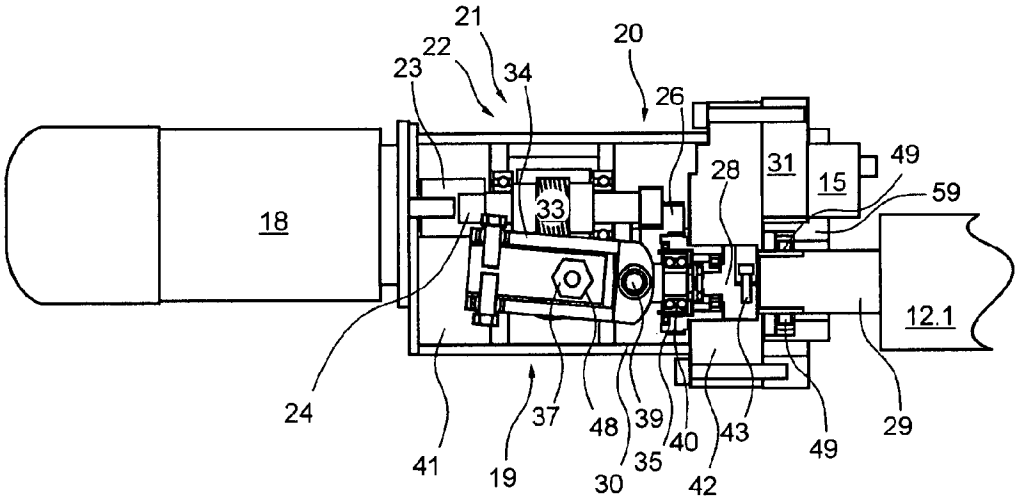
Figure 16:
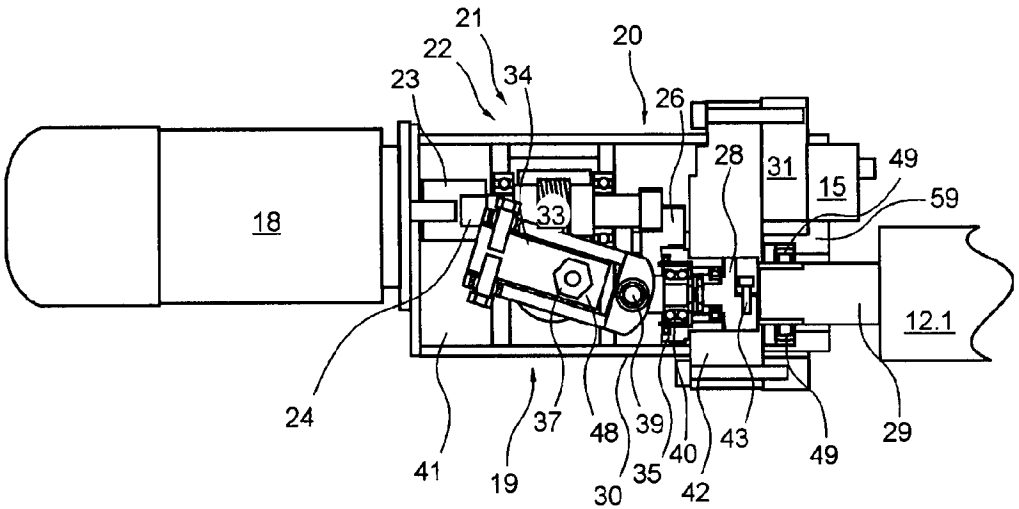
Figure 17:
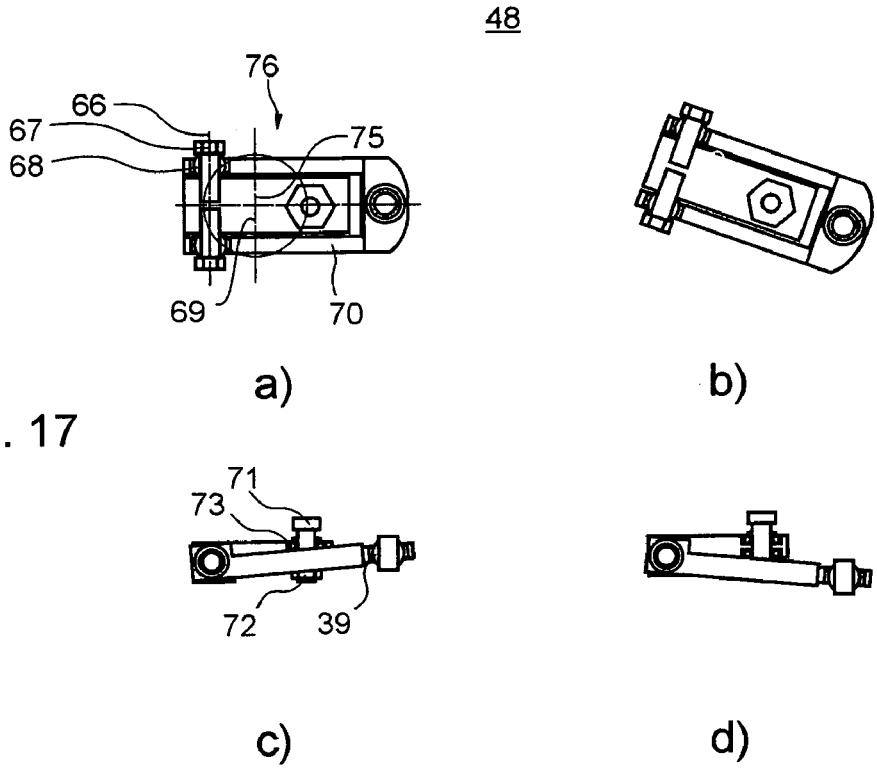
Figure 18:
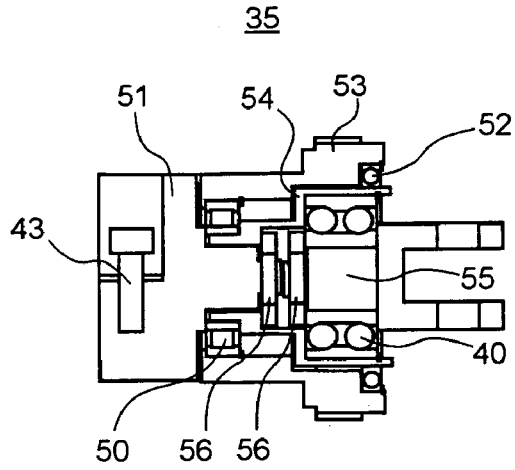

The drawings show:

FIG. 1 a schematic representation of a printing unit;

FIG. 2 an enlarged representation of a blanket-to-blanket printing unit in a flat configuration during print operation with inking units, each of which has a two-track roller train with two distribution cylinders, with:

a) one forme cylinder having a maximal circumference and b) one forme cylinder having a minimal circumference;

FIG. 3 a schematic representation of the assembly positions of two distribution cylinders of an inking unit having a two-track roller train of a printing couple of the blanket-to-blanket printing unit of FIG. 2, with:

a) one forme cylinder having a maximal circumference and b) one forme cylinder having a minimal circumference;

FIG. 4 a schematic representation of a) the production direction of rotation and b) the driving layout for a printing couple of the blanket-to-blanket printing unit of FIG. 2;

FIG. 5 a schematic representation of a) the direction of rotation counter to the production direction of rotation during the washing of inking units and b) the driving layout for a printing couple of the blanket-to-blanket printing unit of FIG. 2;

FIG. 6 a schematic representation of a distribution cylinder, positioned swiveled away from a forme roller, from a) a side view and b) a front view;

FIG. 7 a schematic representation of the fixed axial distance between the distribution cylinders of a printing couple of the blanket-to-blanket printing unit of FIG. 2 with different formats a), b), c) or paper web widths;

FIG. 8 a schematic representation of a transverse oscillating transmission assembly;

FIG. 9 a schematic representation of the transverse oscillating transmission assembly of FIG. 8 in an installed state with rotation in the production direction of rotation;

FIG. 10 a schematic representation of the transverse oscillating transmission assembly of FIG. 8 in an installed state with rotation counter to the production direction of rotation;

FIG. 11 a schematic representation of the transverse oscillating transmission assembly of FIG. 8 in an installed state, swiveled outward;

FIG. 12 a schematic representation of the transverse oscillating transmission assembly of FIG. 8 in a position engaged against a forme roller in:

a) a cross-section which lies in a plane formed by the axes of the distribution cylinders and b) a cross-section perpendicular to the axes of the distribution cylinders;

FIG. 13 a schematic representation of the transverse oscillating transmission assembly of FIG. 8 in a position swiveled away from a forme roller in:

a) a cross-section which lies in a plane formed by the axes of the distribution cylinders and b) a cross-section perpendicular to the axes of the distribution cylinders;

c) a view of the pivoting lever and transverse oscillating transmission assembly from the side;

FIG. 14 a schematic representation of a crank mechanism for axially driving a distribution cylinder which is driven by a drive motor in and counter to the production direction of rotation;

FIG. 15 a schematic representation of a crank mechanism for axially driving a distribution cylinder which is driven by a drive motor only counter to the production direction of rotation, positioned engaged against a forme roller;

FIG. 16 a schematic representation of a crank mechanism for axially driving a distribution cylinder which is driven by a drive motor only counter to the production direction of rotation, positioned swiveled away from a forme roller;

FIG. 17 a schematic representation of a swivelable connecting-rod mechanism from a side view in a) a position engaged against a forme roller and b) a position swiveled away from a forme roller, and from a plan view in c) a position engaged against a forme roller and d) a position swiveled away from a forme roller;

FIG. 18 a schematic representation of a transmission, which is equipped with a one-way clutch in the production direction of rotation, and with a torque-limiting clutch counter to the production direction of rotation.

A printing press, for example a web-fed rotary printing press, particularly a multi-color web-fed rotary printing press, has a printing unit 01, in which a web of material 02, or web 02, can be printed on both sides a single time or, particularly, multiple times in succession, for example four times in this case, or multiple webs can be printed one or more times simultaneously. The printing unit 01 has multiple, in this case four, blanket-to-blanket printing units 03, arranged vertically one above the other, for two-sided printing in blanket-to-blanket operation. The blanket-to-blanket printing units 03—shown here in the form of arch-type or n-printing couples, are each comprised of two printing couples 04, each of which has cylinders 06; 07, one embodied as a transfer cylinder 06 and one embodied as a forme cylinder 07, for example printing couple cylinders 06; 07, and each has an inking unit 08 and, in the case of wet offset printing, also a dampening unit 09. In each unit, between the two transfer cylinders 06 in the engaged position a (blanket-to-blanket) print position 05 is formed. The listed components are identified only in the uppermost blanket-to-blanket printing unit 03 of FIG. 1, however the (blanket-to-blanket) printing couples 03; 04 arranged one above the other can be essentially identical in configuration—particularly with respect to the embodiment of the features that are relevant to the invention. In contrast to the representation shown in FIG. 1, the blanket-to-blanket printing units 03 can just as easily be configured—without the advantageous feature of linear configuration described below—as an upright U-unit, or, as shown in FIG. 2, as a flat blanket-to-blanket printing unit 03, i.e., wherein the axes of rotation of the printing couple cylinders 06; 07 are embodied to lie within a shared plane when in the print-on position.

Forme and transfer cylinders 07; 06 are configured, for example, with a surface width of at least two, for example four or even six, vertical printed pages in newspaper format, particularly in broadsheet format, arranged side by side. In one embodiment, at least the forme cylinders 07 can have a circumference, for example, which corresponds essentially to two printed pages in a newspaper format arranged one in front of the other. In another embodiment, the circumference can correspond to a single printed page of this type.

The inking unit 08, embodied, for example, as a two-track roller inking unit 08 also called an "anilox inking unit," has a plurality of rollers 11; 12; 13; 14; 16. The inking unit 08 according to FIGS. 2, 4, 5 and 6 comprises three rollers 11, particularly forme rollers 11, which apply ink to the printing forme of the forme cylinder 07, which receives the ink from an ink fountain 17 via an oscillating roller 12.1 which is farther away from the dampening unit, particularly distribution cylinder 12.1 (e.g., having a hard surface), a second oscillating roller 12.2 which is close to the dampening unit, particularly distribution cylinder 12.2, another ink or transfer roller 13 (e.g., having a soft surface), a roller 14, particularly film roller 14, and a roller 16, particularly ink fountain roller or dipping roller 16. Dipping and film rollers 16; 14, which are characteristic of a film inking unit, can also advantageously be replaced by some other type of ink supply and/or metering system, for example by a pump system for an ink injector system, or a vibrator system for a vibrator inking unit. It is also conceivable for more than three forme rollers 11 to transfer the ink from the distribution cylinders 12.1; 12.2 to the forme cylinder 07.

The soft surfaces of the forme and/or transfer rollers 11; 13, or soft rollers 11; 13, are embodied as yielding in the radial direction, for example having a rubber layer, which is indicated in FIG. 2 by concentric circles.

When the rollers 11; 12; 13; 14 of the inking unit 08 are then engaged against one another, the hard surfaces of the distribution cylinders 12.1; 12.2 dip to a greater or lesser extent into the soft surfaces of the respectively cooperating soft rollers 11; 13, based upon the contact pressure and/or the path of travel. This causes the circumferential conditions of cooperating rollers 11; 12; 13; 14 rolling against one another to change, depending upon the depth of indentation.

In this case, if one or more cooperating rollers is positively rotationally driven at a preset speed, for example, via a drive motor or a corresponding mechanical drive connection with another driven component, then an adjacent soft roller, which is driven solely by means of friction with the first roller, will rotate at a different speed depending upon the depth of indentation. However, if this soft roller were to also be driven by its own drive motor or additionally via friction at a second nip point by another roller at a set speed, this can result in the first case in a difference between the speed preset by the motor and the speed produced by friction, and in the second case in a difference between the two speeds produced by friction. This will result in slip at the nip points and/or unnecessarily high stress on the drive motor or drive motors.

In the area of the inking unit 08 that is close to the forme cylinder, particularly in the area in which ink is applied by the rollers 11 to the printing forme, the solution described in what follows will result in slip-free rolling, so-called "true rolling," and inking.

The distribution cylinder 12.1 situated distant from the dampening unit is rotationally driven in the direction of production solely via friction with adjacent rollers 11; 13, and does not have a supplementary mechanical drive connection to the drive for the printing couple cylinders 06; 07, or to some other rotationally positively driven roller of the inking unit, or its own drive motor for driving it rotationally in the direction of production (FIGS. 2 and 4). The first distribution cylinder 12.1 is therefore rotationally driven primarily via the three, in this example, forme rollers 11 which are driven via friction with the forme cylinder 07, and, independently of the degrees of indentation at the nip points between them, has essentially the same rotational speed as the forme cylinder 07. The distribution cylinder 12.2 that is close to the dampening unit, as shown in FIG. 2, has a drive motor 18 which rotates it in the direction of production, but which has no mechanical coupling to the first distribution cylinder 12.1 other than the friction gearing formed by the rollers 12.2; 13; 12.1 in a direction of production indicated in FIG. 2. However, the drive motor 18 is capable of driving both the first distribution cylinder 12.1 which is farther away from the dampening unit and the second distribution cylinder 12.2 which is close to the dampening unit in a direction of rotation for washing or set-up, counter to the production direction of rotation. Thus with a positive drive of the distribution cylinders 12.1; 12.2 in set-up operation, in which, for example, the inking unit is washed or doctored in a direction of rotation that is counter to the production direction of rotation, a better result is achieved in that, for example, a washing blade 10 (FIGS. 2, 4, 5, 9 and 10) can be applied without the distribution cylinder 12.1 remaining stationary. In this case, the first distribution cylinder 12.1 which is farther away from the dampening unit is rotationally driven in the production direction of rotation solely via friction with adjacent rollers 11; 13, i.e., that it is configured to be rotationally driven in the production direction of rotation without a mechanical drive connection to the drive motor 18 that would extend beyond friction and would transfer torque, and that the first distribution cylinder 12.1, which is farther away from the dampening unit, is rotationally driven by the drive motor 18 in a direction of rotation for washing or set-up which is counter to the production direction of rotation, i.e., that it is configured with a mechanical drive connection to the drive motor 18 which will transfer torque for its rotation counter to the production direction of rotation. In contrast, the second distribution cylinder 12.2, which is close to the dampening unit, is positively driven by the drive motor 18 in both directions of rotation, in other words both in and counter to the production direction of rotation. This is additional, as friction with adjacent rollers 11; 13 also occurs here. With more than two distribution cylinders 12.1; 12.2, for example, three, the two that are close to the dampening unit can be positively rotationally driven, or only the center distribution cylinder 12.2 or the one that is closest to the dampening unit can be positively rotationally driven.

Preferably, each of the two distribution cylinders 12.1; 12.2 has a transmission 19, particularly an oscillating or frictional transmission 19, symbolized in FIG. 2 through respective double arrows, whereby the distribution cylinders 12.1; 12.2 execute an oscillating movement indicated by double arrows in FIGS. 4*b*) and 5*b*).

In a mechanically less complicated embodiment, the distribution cylinder 12.1 that is farther away from the dampening unit has its own oscillating transmission 19 which converts only its rotational movement, generated in the direction of production solely via friction with an adjacent roller 11; 13, to oscillating movement. This can advantageously be embodied as a cam drive, wherein, for example, an axial stop, fixed to the frame, cooperates with a curved, rotating groove that is fixed to the roller, or an axial stop which is fixed to the roller cooperates in a rotating groove of a cam disk which is fixed to the frame. In principle, this transmission 19 which converts the rotation to oscillating axial movement can be some other suitable transmission 19, for example, embodied as a worm gear or crank mechanism having an eccentric.

As is symbolized in FIG. 2 by a dashed line connecting the double arrows, the oscillating transmission 19 of the first distribution cylinder 12.1 is advantageously mechanically coupled via gearing 21 to the oscillating transmission 19 of the second distribution cylinder 12.2. Advantageously, the two coupled oscillating transmissions 19 form a shared oscillating drive 22 or oscillating gearing 22, and are positively driven in their oscillating movement by a drive motor 18. Preferably, the oscillating gearing 22 is positively driven by the drive motor 18 which drives the rotation of the second distribution cylinder 12.2 in the production direction of rotation (FIGS. 2 and 12).

The inking unit 08, schematically represented again in FIGS. 4, 5 and 6, has an improved print quality with a simultaneously shorter inking unit 08 and thus thinner ink layers in the inking unit 08, resulting in less spraying and less fogging in the inking unit 08. Preferably, at least one distribution cylinder 12.1 of the roller train is rotationally driven in the print-on position (FIGS. 4 and 5) in the production direction of rotation (FIG. 4) solely via friction with at least one adjacent roller 11; 13, and counter to the production direction of rotation (FIG. 5) is positively driven via a motor. Preferably, the distribution cylinder 12.1 which is rotationally driven in the production direction of rotation solely via friction with at least one adjacent roller 11; 13 is a distribution cylinder 12.1 that is farther away from the dampening unit. Preferably, the distribution cylinder 12.2 which is additionally rotationally driven both in and counter to the production direction of rotation by the drive motor 18 is a distribution cylinder 12.2 that is close to the dampening unit. In this case, in the print-on position (FIGS. 4 and 5), an oscillation of the distribution cylinders 12.1; 12.2, indicated in FIGS. 4*b*) and 5*b*) by double arrows, takes place in the directions of rotation both in and counter to the production direction of rotation, whereas in the print-off position (FIG. 6) no oscillation occurs in the idle mode. The positive driving of the distribution cylinder 12.2 in the production direction of rotation is indicated in FIG. 4*b*) by a turning arrow, as is the positive driving of both distribution cylinders 12.1; 12.2 counter to the production direction of rotation in FIG. 5*b*).

FIGS. 12 and 13 show an advantageous embodiment of the drive of the distribution cylinders 12.1; 12.2, wherein only the second distribution cylinder 12.2 is positively rotationally driven in the production direction of rotation, while both distribution cylinders 12.1, 12.2 are positively rotationally driven axially and counter to the production direction of rotation via the shared oscillating drive 22.

In this, the drive motor 18 drives a drive sprocket 26, via a clutch 23 and a shaft 24, which sprocket in turn cooperates with a cylindrical gear 27 which is non-rotatably connected to the second distribution cylinder 12.2. Between the drive sprocket 26 and the cylindrical gear 27 an intermediate gear 25 is arranged. The connection can be made, for example, via an axial section 28 which supports the cylindrical gear 27 on a journal 29 of the second distribution cylinder 12.2. A corresponding axial section 28 of the first distribution cylinder 12.1 has a transmission 35, shown enlarged in FIG. 18, in the form of a cylindrical gear 35 with a one-way clutch 50 in the production direction of rotation, or in the production direction of rotation has no mechanical drive connection with the drive motor 18 that will transfer torque.

Thus the distribution cylinder 12.1 which is rotationally driven in the production direction of rotation exclusively via friction with at least one adjacent roller 11; 13, and which is equipped with a mechanical drive connection to the drive motor 18 which transfers torque for driving it in the washing or set-up direction of rotation, which is counter to the production direction of rotation, is connected via the transmission 35 or cylindrical gear 35 to the drive motor 18, which transmission is equipped with a one-way clutch 50 in the production direction of rotation, and in the washing and set-up direction of rotation, which is counter to the production direction of rotation, is equipped with a torque-limiting clutch.

A one-way clutch 50 in the present context is understood as a clutch that is independent of the direction of rotation. The production direction is understood as the direction of rotation during printing.

The drive connections between drive sprocket 26 and cylindrical gear 35 of the first distribution cylinder 12.1 and between drive sprocket 26 and cylindrical gear 27 of the second distribution cylinder 12.2 are preferably evenly toothed, and configured with a contact ratio in the tooth engagement that is large enough for each position of the oscillating movement. The two distribution cylinders 12.1; 12.2 are mounted in a side frame 31 in bearings 32, for example radial bearings 32, which also enable axial movement (FIGS. 15 and 16). In this case there is no rotational drive connection between the drive motor 18 and the first distribution cylinder 12.1 in the production direction of rotation. The one-way clutch 50 of the transmission 35 embodied as a cylindrical gear 35 is unable to transfer torque to the supporting clamping hub 51 (FIG. 18) on the journals 29 of the first distribution cylinder 12.1 in the production direction of rotation. Drive sprocket 26 and the cylindrical gear 27 arranged on the axial section 28 together form a transmission, particularly speed-reduction gearing, for rotational driving in and counter to the production direction of rotation. Drive sprocket 26 and the cylindrical gear 35 arranged on the axial section 28 together form a transmission, particularly speed-reduction gearing, for rotational driving counter to the production direction of rotation. The two transmissions represent a closed and/or pre-assembled unit which has its own housing 30. The unit can be coupled to the journals 29 at the output side.

The oscillating drive 22 is also driven by the drive motor 18, for example via a worm gear mechanism 33, 34. In this case, oscillation is carried out by means of a worm 33 or a section of the shaft 24 embodied as a worm 33, arranged outside of the shaft 24, on a worm gear 34, which is non-rotatably connected to a shaft 36 which extends perpendicular to the rotational axis of the distribution cylinder 12.1; 12.2. At each end surface of the shaft 36, eccentrically to its rotational axis, a carrier 37 is arranged, which is in turn connected, rigid to compression and tension in the axial direction of the distribution cylinders 12.1; 12.2, to the journals 29 of the distribution cylinders 12.1; 12.2, for example, via a crank mechanism, for example, via a connecting rod 38 which is rotatably mounted on the carrier 37 and a joint 39. In FIG. 8, the friction gearing 19 of the distribution cylinder 12.1 which is farther away from the dampening unit and that of the distribution cylinder 12.2 which is close to the dampening unit are merely suggested, because in this view they are covered by cylindrical gear 35 and cylindrical gear 27, respectively. A rotation of the shaft 36 causes the carrier 37 to rotate, which in turn effects axial movement of the distribution cylinders 12.1; 12.2 via the crank mechanism. Output to the oscillating drive 22 can also occur at a different location in the rotary drive train between drive motor 18 and distribution cylinder 12.2 or even on the other side of the machine from the journal 29 which is located at the other end surface of the distribution cylinder 12.2, in a corresponding oscillating transmission 22. It is also possible for a transmission other than a worm drive 33, 34 to be provided for uncoupling the axial drive.

As is shown in FIGS. 12 and 13, the oscillating drive 22 or the oscillating gearing 22 is embodied as a complete unit with its own housing 41, which can also be embodied as encapsulated. The oscillating gearing 22 can be lubricated within the encapsulated chamber either with oil, or, preferably, with a grease. In the illustrated embodiment, the oscillating gearing 22 is supported by a fixture 42 connected to the side frame 31. The drive motor 18 is thereby separably connected to the housing 41 of the oscillation gearing 22.

FIG. 5 and/or 16 show an advantageous embodiment of a non-rotatable connection between the axial section 28 and the respective journals 29. In this case, rotation involves a frictional connection, which is produced via a clamping of a narrowed part of the journal 29 by the slotted axial section 28 which encompasses it. The position of a clamping screw 43 is dimensioned such that it—viewed crosswise to the rotational axis of the journal 29—dips at least partially into a continuous groove in the journal 29. In an axial direction, it therefore secures the connection in an interlocking fashion.

In reference to FIGS. 12, 13, 14, 15 and 16, a further advantageous development will be specified, wherein the distribution cylinders 12.1; 12.2, including rotational and axial drive, are arranged in the manner of a fully preassembled and/or movable module on their own side frame 31, which is structurally separate from a side frame 44 that supports the printing couple cylinders 06; 07. A second frame side which supports the distribution cylinders 12.1; 12.2 at their other end surface is not shown in FIGS. 14, 15 and 16. These side frames 31 which support the distribution cylinders 12.1; 12.2 and their drive can then be positioned on the side frame 44, depending upon the size and geometric configuration of the printing couple cylinders 06; 07.

The transmission unit (comprising axial transmission and/or oscillating gearing 22), preferably preassembled as a module, can be completely preassembled as a sub-unit for the inking units 08, which are embodied, by way of example, as a module, and in an advantageous embodiment can be preassembled on the side frame 31 of the inking unit module even prior to installation in the printing unit 01. The modularity feature also permits installation/replacement/exchange of the transmission embodied as a module even after the inking unit module has been installed in the press.

Because the distribution cylinder 12.1 which is farther away from the dampening unit has no positive rotational drive in the production direction of rotation, the rollers 11 (13) roll against one another largely slip-free, at least in the area of the inking unit that lies farther away from the dampening unit.

In principle, the drive motor 18 which rotationally drives the second distribution cylinder 12.2 both in the production direction of rotation and counter to the production direction of rotation can be embodied as an electric motor, which can be controlled or regulated with respect to its output and/or its torque and/or also with respect to its speed. In the latter case—if the drive motor 18 is also operated with speed regulation/control in print-on mode—the aforementioned problems related to different effective roller circumferences can still occur in the area of the inking unit 08 that is close to the dampening unit.

However, with respect to the above-described set of problems involving a preset speed that competes with the friction gearing, the drive motor 18 is advantageously embodied such that it can be controlled or regulated in terms of its output and/or its torque at least during print operation. In principle, this can be implemented by means of a drive motor 18 embodied as a synchronous motor 18 or as an asynchronous motor 18:

In a first embodiment, which is the simplest in terms of complexity, the drive motor 18 is embodied as an asynchronous motor 18 in which only a frequency, for example in the print-off mode of the inking unit 08, as shown in FIG. 13, and/or an electric drive output or a torque in print-on mode of the inking unit 08, as shown in FIG. 12, is preset in an allocated drive control 46 (FIG. 12). In the print-off mode of the inking unit 08, i.e., the forme rollers 11 are out of rolling contact with the forme cylinder 07 (FIGS. 6, 11 and 13), the inking unit 08 can be brought via a preset frequency to a peripheral speed in the production direction of rotation which is suitable for the print-on mode by means of the second distribution cylinder 12.2, at which speed the peripheral speeds of forme cylinder 07 and forme rollers 11 differ from one another by less than 10%, especially less than 5%. This limit is also advantageously a condition for the print-on setting of the embodiments specified in what follows. A preset frequency or output or torque value that is suitable for this purpose can be determined in advance either empirically or through calculation, and can be stored either in the drive control system itself, a machine control system or a control room computer, wherein the preset value can preferably be modified by the press operator. This also advantageously applies to the preset values described below.

In print-on mode, i.e., the forme rollers 11 are in rolling contact with the forme cylinder 07 and all rollers 11; 12.1; 12.2; 13; 14 of the inking unit 08 are engaged against one another, as illustrated schematically in FIGS. 1, 2, 4, 5, 9, 10 and 12, the rollers 11; 12.1; 13; 12.2; 13; 14 are rotationally driven in part by the forme cylinder 07 via the frictional gearing now produced between the rollers 11; 12.1; 13; 12.2; 13; 14 in the production direction of rotation (FIGS. 2, 4 and 9) or counter to the production direction of rotation (FIGS. 5 and 10), so that the drive motor 18 is required to input only the dissipated power, which increases in the frictional gearing as the distance from the forme cylinder 07 increases. In other words, the drive motor 18 can be operated at a low (drive) torque or a low driving power, which contributes only to keeping the rear area of the inking unit 08 at the peripheral speed which is determined essentially through frictional contact. In a first variant this driving power can be left constant for all production speeds or speeds of the forme cylinder 07 and either can correspond to the preset value for start-up in print-off mode or can represent a separate constant value for production. In a second variant, different preset values for frequency and/or driving power can be preset and stored for different production speeds and also, optionally, for start-up in print-off mode. Depending upon the production speed, correspondingly according to the production rate, the preset value for the drive motor 18 can then vary.

In a second embodiment, the drive also has a speed feedback loop in addition to the drive control 46 (FIG. 12) and the asynchronous motor 18 of the first embodiment, so that when the inking unit is operating in the print-off mode phase (FIGS. 6, 11 and 13) the drive motor 18 can essentially be synchronized with the speed of the assigned forme cylinder 07 or the printing couple cylinders 06; 07. For this purpose, a sensor device 47, for example an angular sensor 47, which detects actual speed can be arranged on a rotating component which is non-rotatably attached to the distribution cylinder 12.2, for example a rotor of the drive motor 18, the shaft 24, the axial section 28 or the journal 29 (FIG. 12). In FIG. 12, an angular sensor 47 comprising a rotating initiator and a stationary sensor device 47 is shown by way of example on the clutch 23, the signal from which is passed on to the drive control 46 for further processing via a signal connection, indicated by a dashed line. By means of the speed feedback loop, the comparison with a speed M which represents the machine speed, and a corresponding adjustment of the preset output or frequency value, a slip in the torque of the print-on position can be avoided or at least minimized to a low percentage. In print-on operation, the drive motor 18 is then preferably no longer operated strictly on the basis of the described speed feedback loop, but essentially according to the above-described preset frequency or output value.

A third embodiment has a synchronous motor 18 in place of the asynchronous motor 18 of the second embodiment. A speed feedback loop and a synchronization and control in the print-off phase on this basis are carried out in accordance with the second embodiment, for example again in the drive control 46.

In a fourth embodiment, a drive motor 18, particularly a synchronous motor 18, is provided, which is optionally speed-controlled in a first mode (for the inking unit 08 in print-off) and in a second mode can be controlled with respect to torque (for the inking unit 08 in print-on). Drive control 46 and drive motor 18 preferably again have an internal control loop for speed control, which, similar to the second embodiment, comprises a feedback loop from an external angular sensor 47 or a sensor system internal to the motor. If synchronous motors 18 are used, a shared frequency converter or changer can be assigned to several of these synchronous motors 18 of a printing unit 01.

A further development of the fourth embodiment, which is advantageous in terms of versatility but is more complex, involves the embodiment of the drive motor 18 as a servomotor 18 that can optionally be position and torque controlled, i.e., a three-phase synchronous motor with a device which makes it possible to determine the current rotational position or the traveled rotational angle in relation to a starting position of the rotor. The return information on the rotational position can be provided by means of an angular sensor, for example a potentiometer, a resolver, an incremental position transducer or an absolute value transducer. In this embodiment, each drive motor 18 is assigned its own frequency converter or changer.

In the case of a drive motor 18 embodied in accordance with the second, third or particularly fourth embodiment and at least speed-synchronizable, particularly speed-controllable, the drive control 46 is advantageously signal connected to a so-called virtual axis, in which an electronically generated axis position Φ rotates. The rotating axis position Φ is used for synchronization with regard to the correct angular position and its change over time (angular velocity Φ) in mechanically independent drive motors of units which are allocated to the same web, particularly drive motors of individual printing couple cylinders or groups of printing couple cylinders and/or the drive of a folding unit. In the operating mode in which the inking unit 08 is to be driven in synchronization with the speed of the forme cylinder 07, a signal connection with the virtual axis can thus supply the drive control 46 with the information on the machine speed or machine rate.

Preferably, when the distribution cylinder 12.2 is being driven via the drive motor 18, the procedure is therefore such that when the inking unit 08 is running in the production direction of rotation but is in the print-off position (i.e., disengaged forme rollers 11) the drive motor 18 is driven controlled or regulated with respect to a speed, and when the printing press is running, once the inking unit 08 (i.e., the forme rollers 11) has been placed in print-on, the speed regulation or control is purposely dispensed with. In other words, a speed is no longer maintained, rather the drive motor 18 is operated for the remainder of the process based upon a torque, for example through a preset electrical power level, and/or based upon a torque that can be adjusted at the controller of a drive motor 18, particularly an asynchronous motor 18. The torque that is to be adjusted, or the power that is to be adjusted, is chosen to be lower, for example, than a threshold torque which would lead to a first rotation (under slip) of the distribution cylinder 12.2 driven in the production direction of rotation with cooperating rollers 13 that are engaged but set with respect to rotation.

The load characteristic of a drive motor 18 embodied as an asynchronous motor 18 approaches the behavior targeted for the current purpose in such a way that as the load increases the frequency decreases with a simultaneous increase in drive torque. If, for example, much of the driving power originating with the forme cylinder 07, and thus much of the peripheral speed, is lost in the friction gearing between forme cylinder 07 and the second distribution cylinder 12.2, so that the load on the drive motor 18 increases, the increased torque will be supplied at a decreased frequency. Conversely, little torque will be transferred by the drive motor 18—it will run quasi idle—when, for example, in the production direction of rotation, sufficient energy is transferred via the friction gearing to the distribution cylinder 12.2.

Further, the inking unit 08, as schematically illustrated in FIGS. 2, 3 and 7, has a constant distance between the distribution cylinders 12.1; 12.2 for all formats, in other words for different circumferences and different material web widths. The axial distance A between the two distribution cylinders 12.1; 12.2 is thereby identical for different forme cylinder diameters, as is indicated in FIGS. 2*a*) and 3*a*) for a forme cylinder 07 with a maximal circumference and in FIGS. 2*b*) and 3*b*) for a forme cylinder 07 with a minimal circumference. Advantageous result from this in that, regardless of the diameter of the forme cylinder 07, an identical or structurally equivalent transverse oscillating transmission assembly 45, illustrated in FIGS. 4*b*), 5*b*), 6*b*), 8, 9, and 11, and comprised of oscillation gearing 19, cylindrical gearing 20, transmission 21 and oscillating drives 22 can be used for all formats, in other words for different circumferences and different material web widths.

At least one distribution cylinder 12.1; 12.2 can be swiveled outward, for example for maintenance purposes or for washing inking units, from a position shown in FIGS. 4, 5, 9 and 10 in which it is engaged against a forme roller 11 to a position shown in FIGS. 6 and 11, in which it is swiveled away from the forme roller 11, preferably in the idle mode. To this end, a connecting-rod mechanism 48 that can be swiveled outward, shown in FIG. 17, is provided for swiveling the at least one distribution cylinder 12.1; 12.2 outward (FIGS. 12 and 13).

The inking unit 08 thus has the following properties:

a) Rotational drive for only one of multiple distribution cylinders 12.1; 12.2 in print operation, for the purpose of decreasing slip, wear, and driving stress caused by different effective diameters of cylinders 06; 07 engaged against soft rollers 11; 13 (FIGS. 4 and 9).

b) Rotational positive drive of all distribution cylinders 12.1; 12.2 in start-up operation counter to the production direction, to enable an inking unit washing or doctoring in the direction of rotation counter to print operation (FIGS. 5 and 10). During doctoring/inking unit washing, rotation occurs in a direction of rotation counter to the production direction, as shown in FIGS. 5 and 10. In this, the distribution cylinders 12.1; 12.2 are positively driven, to prevent them from being brought to idle mode by a washing blade, thereby resulting in an unsatisfactory washing result.

c) Distribution cylinders 12.1; 12.2 that can be swiveled outward for maintenance purposes in the idle mode by means of a swivelable connecting-rod mechanism 48 (FIG. 17), in order to improve accessibility during inking unit washing and/or changing of the forme cylinder, for example (FIGS. 6 and 11). To change the second, center forme roller 11 upward, it is necessary to move the distribution cylinder 12.1 which in print operation is driven via friction far enough away from the forme cylinder 07, which is in print-off mode, that the distance between the two surfaces is greater than the diameter of the forme roller 11 to be removed. This is possible only when the printing press is in idle mode. The outward swiveling offers a user-friendly solution which requires no disassembly of components. To create space for removal of the center forme roller 11 the distribution cylinder 12.1 is mounted in a swivel arm 59, as shown in FIGS. 12, 13, 15 and 16. FIGS. 12 and 15 show a position in which the distribution cylinder 12.1 that is farther away from the dampening unit is swiveled closed, and FIGS. 13 and 16 show a position in which it is swiveled open. The distribution cylinder 12.1 that is farther away from the dampening unit is mounted at both ends in a bearing 49, as shown in FIGS. 12 and 13, preferably in a cylindrical roller bearing 49 with a universal ball joint on the outer ring, and these are in turn located in swivelable levers 59 on the inside of the frame, which form the swivel arm 59. FIGS. 15 and 16 each show an enlarged illustration of only the drive side. The spherical plain bearings are necessary to compensate for misalignment when the swivel arm 59 on one side is engaged/disengaged. This makes synchronous disengagement unnecessary. The fulcrums of the swivel arms 59 and the center points of the roller sockets 15 of the inking rollers 13 thereby coincide (FIG. 13 c)). Preferably, the swivel arms 59 are mounted about the roller sockets 15, and their position is adjustable in relation to a fulcrum point 63 which is fixed on the frame by means of 62 adjusting screws and adjusting nuts 64. In side frame 44, stops 60, 61 for a swivel arm position are provided in the engaged (stop 60) and disengaged (stop 61) position. Through a clever positioning or arrangement of the intermediate gear 25 (positioned toward the center of the inking roller 13), the cylindrical gear 35 with one-way clutch 50 remains with its teeth engaged with those of the intermediate gear 25 even when the distribution cylinder 12.1 is swiveled outward. To this end, the module of toothing of intermediate gear 25 and cylindrical gear 35 with one-way clutch 50 is preferably adjusted (preferably m=2) and the installed axial distance is preferably chosen to be 0.5 mm larger than the nominal axial spacing of the teeth. The swivelable connecting-rod mechanism 48 shown in FIG. 17 has a connecting rod 70 that can be swiveled outward about a rotational axis 66 in relation to a fixed connecting rod 69. On the swivelable connecting rod 70 a joint 39 is provided, for producing a connection with a mounting of the distribution cylinder 12.1 that supports the bearing 49. The fixed connecting rod 69 and the swivelable connecting rod 70 are rotatable about a crank axis 75. A slotted anchor 71 is arranged on the fixed connecting rod 69. The slotted anchor 71 is secured with a nut 72 on a bearing 73, for example roller bearing 73, on the connecting rod 70. Slotted anchor 71 and crank axis 75 form an eccentric 76. Fixed connecting rod 69 and swivelable connecting rod 70 are connected to one another by means of fit bolts 67 and bearings 68, for example spherical plain bearings 68.

d) Identical or structurally equivalent transverse oscillating transmission assembly 45 for all formats having different circumferences or different paper web widths, allowing the inking unit 08 to be used universally in combination with forme cylinders 07 having different diameters (FIGS. 2, 3 and 7). By maintaining a fixed axial distance A of 240 mm, for example, between the two distribution cylinders 12.1; 12.2, the same transverse oscillating transmission assembly 45 can be used, even when larger roller diameters for large paper web widths are used. Only the swivel arm distance from the center of inking roller 13 to the center of distribution cylinder 12.1; 12.2, as indicated in FIG. 7 in the example of a double-width 4/2 printing press in FIG. 7*a*) and a triple-width 6/2 printing press in 7*b*), must be adjusted as shown in FIG. 7*c*). Advantageously, for 4/2 printing presses a distribution cylinder diameter of 185 mm and an ink transfer roller diameter of 150 mm are used. Advantageously, for 6/2 printing presses, a distribution cylinder diameter of 196 mm and an ink transfer roller diameter of 170 mm are used, however other diameter combinations are also possible. Based upon the different circumferences of, for example, a minimum of 940 mm to, for example, a maximum of 1,156 mm, different installed angular positions for the distribution cylinders 12.1; 12.2 relative to one another result, as shown in FIGS. 2*a*) and 3*a*) for a maximal circumference and in FIGS. 2*b*) and 3*b*) for a maximal circumference. These different installed angular positions are represented by lines connecting the distribution cylinder axes, which lines are at different angles in relation to vertical. The axial distance A of distribution cylinder 12.1 from distribution cylinder 12.2 preferably corresponds to A=240 mm, whereby different installed angular positions of min. 10° to max 35° degrees result in the printing couple 04. In this range, the transverse oscillating transmission assembly 45 can be operated without pump-operated circulating oil lubrication. All necessary transmission components are lubricated via an existing oil pan lubrication. Only the one-way clutch 50 of the cylindrical gear 35 is lifetime lubricated with grease. It is also possible to embody all bearings as lifetime lubricated with grease and to lubricate the respective toothed gears with special grease.

The transmission 35 or cylindrical gear 35 is comprised essentially, as shown in FIG. 18, of a cylindrical gear 53, which is connected to the clamping hub 51 via the one-way clutch 50. The clamping hub 51 has a clamping screw 43 for clamping to the journal 29 of distribution cylinder 12.1 (FIGS. 15 and 16). A tension bolt 55 is held by means of a bearing 40, for example roller bearing 40, in a bushing 54 inside the cylindrical gear 53. The bushing 54 secures an axial alignment between the journals 29 of the distribution cylinder 12.1 or the clamping hub 51 and the tension bolt 55. A slotted nut 56 holds the roller bearing 40 on the tension bolt 55. A bearing 52, for example roller bearing 52, and the one-way clutch 50 support the bushing 54 radially in relation to the cylindrical gear 53.

The drive motor 18 of the distribution cylinder or cylinders 12.1; 12.2 is not in positive drive connection with the forme cylinder 07.

At least the forme cylinder 07 which is to be inked by the inking unit 08 has a different drive motor from the inking unit 08 that is driven by the drive motor 18, and said different drive motor is preferably angular position controlled.

Preferably, each of the forme cylinders 07 and each of the transfer cylinders 06 has its own angular position controlled drive motor.

LIST OF REFERENCE SYMBOLS

01 Printing unit
02 Material web, web
03 Blanket-to-blanket printing unit
04 Printing couple
05 Print position, blanket-to-blanket print position
06 Cylinder, printing couple cylinder, transfer cylinder
07 Cylinder, printing couple cylinder, forme cylinder
08 Inking unit, roller inking unit
09 Dampening unit
10 Washing blade
11 Roller, forme roller
12 Roller, distribution cylinder
13 Roller, inking roller, transfer roller
14 Roller, film roller
15 Roller socket
16 Roller, ink fountain roller, dipping roller
17 Ink fountain
18 Drive motor, synchronous motor, asynchronous motor, servomotor
19 Transmission, oscillating gearing, friction gearing
20 Cylindrical gear transmission
21 Transmission
22 Oscillating drive, oscillating gearing
23 Clutch
24 Shaft
25 Intermediate gear
26 Drive sprocket
27 Cylindrical gear
28 Axle section
29 Journal
30 Housing
31 Side frame
32 Bearing, radial bearing
33 Worm
34 Worm gear
35 Transmission, cylindrical gear
36 Shaft
37 Carrier
38 Connecting rod
39 Joint
40 Bearing, roller bearing
41 Housing
42 Fixture
43 Clamping screw
44 Side frame
45 Transverse oscillating transmission assembly
46 Drive control
47 Sensor system, angular sensor
48 Connecting-rod mechanism
49 Bearing, cylinder roller bearing
50 One-way clutch
51 Clamping hub, supporting
52 Bearing, roller bearing
53 Cylindrical gear
54 Bushing
55 Tension bolt
56 Slotted nut
57 —
58 —
59 Swivel arm, lever
60 Stop
61 Stop
62 Adjusting screw
63 Fulcrum, stationary on frame
64 Adjusting nut (63)
65 —
66 Axis of rotation
67 Fit bolt
68 Bearing, spherical plain bearing

69 Connecting rod
70 Connecting rod, swivelable
71 Slotted anchor
72 Nut
73 Bearing, roller bearing
74 —
75 Crank axis
76 Eccentric
12.1 Roller, distribution cylinder, farther away from dampening unit, first
12.2 Distribution cylinder, close to dampening unit, second
A Axial distance
M Speed

The invention claimed is:

1. An inking unit of a printing press comprising:

a forme cylinder in said printing press;

an inking roller train in said inking unit and including a plurality of inking rollers usable to ink said forme cylinder;

first, second and third ink forme rollers in said inking roller train and each in engagement with said forme cylinder;

a first distribution cylinder in said inking roller train, said first distribution cylinder being in frictional contact with two adjacent ones of said ink forme rollers and being rotationally driven in a production direction of rotation of said inking unit solely by said frictional contact with said two adjacent ones of said ink forme rollers in said inking roller train;

a second distribution cylinder in said inking roller train, said second distribution cylinder being in contact with a third one of said ink forme rollers;

a drive motor in said inking unit;

a first mechanical drive connection between said drive motor and said second distribution cylinder for positively rotationally driving said second distribution cylinder both in said production direction of rotation of said inking unit and counter to said production direction of rotation of said inking unit by said drive motor; and a second mechanical drive connection between said drive motor and said first distribution cylinder for positively rotationally driving said first distribution cylinder counter to said production direction of rotation of said inking unit, said second mechanical drive connection between said first distribution cylinder and said drive motor including a one-way clutch which is operable to transmit positive drive rotation to said first distribution cylinder from said drive motor only counter to said production direction of rotation of said inking unit.

2. The inking unit of claim 1, further including a drive motor control for said drive motor and wherein said drive motor is operated one of controlled and regulated with respect to one of an output and a torque at least during a printing operation in which said inking unit is in a print-on position.

3. The inking unit of claim 1, further including a shared oscillating gearing system for providing a forced oscillating movement of said first and said second distribution cylinders.

4. The inking unit of claim 3, wherein said shared oscillating gearing is driven by said drive motor.

5. The inking unit of claim 3, further including a first oscillation drive for said first distribution cylinder and a first oscillation drive transmission usable to convert rotational movement of said first distribution cylinder in said production direction into axial movement and further including a second oscillation drive for said second distribution cylinder, said first oscillation drive and said second oscillation drive being in drive connection with each other.

6. The inking unit of claim 1, further including a transmission including a one-way clutch for transferring a torque to said first distribution cylinder to rotationally drive said first distribution cylinder counter to said production direction of rotation of said inking unit, said transmission further including a torque-limiting clutch in said direction of rotation counter to said production direction of rotation.

7. The inking unit of claim 1, wherein said drive motor has no positive drive connection with said forme cylinder.

8. The printing unit of claim 1, further including a forme cylinder drive motor different from said first and said second distribution cylinder drive motor.

* * * * *